US011125475B2

(12) United States Patent
Matthews

(10) Patent No.: US 11,125,475 B2
(45) Date of Patent: Sep. 21, 2021

(54) CRYOGENIC COOLING SYSTEM

(71) Applicant: OXFORD INSTRUMENTS NANOTECHNOLOGY TOOLS LIMITED, Abingdon (GB)

(72) Inventor: Anthony Matthews, Oxon (GB)

(73) Assignee: OXFORD INSTRUMENTS NANOTECHNOLOGY TOOLS LIMITED, Oxon (GB)

( * ) Notice: Subject to any disclaimer, the term of this patent is extended or adjusted under 35 U.S.C. 154(b) by 2 days.

(21) Appl. No.: 16/828,780

(22) Filed: Mar. 24, 2020

(65) Prior Publication Data

US 2020/0370792 A1 Nov. 26, 2020

(30) Foreign Application Priority Data

May 23, 2019 (GB) ..... 1907259

(51) Int. Cl.

| | |
|---|---|
| ***F25B 9/12*** | (2006.01) |
| ***F25B 9/02*** | (2006.01) |
| ***F25B 49/00*** | (2006.01) |
| *F25B 25/00* | (2006.01) |
| *F25B 9/14* | (2006.01) |
| *F28D 21/00* | (2006.01) |
| *F25B 9/10* | (2006.01) |

(52) U.S. Cl.

CPC ..... *F25B 9/12* (2013.01); *F25B 9/02* (2013.01); *F25B 49/00* (2013.01); *F25B 9/10* (2013.01); *F25B 9/145* (2013.01); *F25B 25/005* (2013.01); *F28D 2021/0033* (2013.01)

(58) Field of Classification Search

CPC .... F25B 9/02; F25B 9/145; F25B 9/10; F25B 25/005; F25B 9/12; F28D 2021/0033

See application file for complete search history.

(56) References Cited

U.S. PATENT DOCUMENTS

| | | | | |
|---|---|---|---|---|
| 4,277,949 | A * | 7/1981 | Longsworth | F17C 3/085 165/104.34 |
| 6,758,059 | B2 | 7/2004 | Kelly et al. | |
| 9,243,825 | B2 * | 1/2016 | Mikheev | F28D 15/0275 |
| 9,816,750 | B2 * | 11/2017 | Batey | F25B 9/12 |
| 10,258,253 | B2 * | 4/2019 | Garside | F25B 9/14 |

FOREIGN PATENT DOCUMENTS

| | | | |
|---|---|---|---|
| GB | 2493553 | A | 2/2013 |

* cited by examiner

*Primary Examiner* — Frantz F Jules
*Assistant Examiner* — Lionel Nouketcha
(74) *Attorney, Agent, or Firm* — Blank Rome LLP

(57) ABSTRACT

A cryogenic cooling system is provided comprising a first stage 6, a second stage 7, and a third stage 8, wherein the second stage 7 is arranged between the first stage 6 and the third stage 8. A first dilution unit 12 is provided comprising a first still 11 and a first mixing chamber 13, wherein the first still 11 is thermally coupled to the first stage 6 and the first mixing chamber 13 is thermally coupled to the third stage 8. A second dilution unit 32 is further provided comprising a second still 31 and a second mixing chamber 33, wherein the second still 31 is thermally coupled to the first stage 6 and the second mixing chamber 33 is thermally coupled to the second stage 7.

19 Claims, 5 Drawing Sheets

CRYOGENIC COOLING SYSTEM

CROSS REFERENCE TO RELATED APPLICATION

This application claims priority to Great Britain Application No. 1907259.4 filed May 23, 2019, the entire content of which is hereby incorporated by reference.

FIELD OF THE INVENTION

The present invention relates to a cryogenic cooling system, more particularly a cryogenic cooling system including a dilution unit.

BACKGROUND TO THE INVENTION

There are a number of applications that require cooling to millikelvin temperatures. Such temperatures can be obtained by operation of a dilution refrigerator. A dilution refrigerator typically comprises multiple stages, each stage being configured to obtain a respective temperature during operation of the dilution refrigerator. Components can be thermally coupled to these stages to address the specifics of the application.

A dilution unit will form part of the dilution refrigerator, the dilution unit comprising a still and a mixing chamber, connected by a set of heat exchangers. An operational fluid formed of a helium-3/helium-4 mixture is circulated around the dilution unit during operation. The still and the mixing chamber form active sources of cooling in that they apply cooling (i.e. can remove energy from the system) as a result of a phase change or mixing of the operational fluid. Cooling is obtained at the mixing chamber from the enthalpy of mixing as helium-3 is diluted into helium-4. The mixing chamber is thereby operable so as to obtain the lowest temperature of any part of the dilution refrigerator. Helium-3 is boiled at the still, which removes energy due to the latent heat of vaporisation. A cold plate is arranged between the still and the mixing chamber and generally obtains a temperature between these two components during use. The cold plate forms an intermediary heat sink (often used as a convenient mounting point for various experimental services) that is passively cooled by out-flowing helium-3, flowing from the mixing chamber to the still, but has no active cooling process. As such, any heat load applied to the cold plate is parasitic, and will impact directly on the base temperature of the mixing chamber.

An example of a prior art dilution unit is shown by FIG. 1. Operational fluid flows between the still 102 and the mixing chamber 105 through two counter-flow paths in a heat exchanging unit. The heat exchanging unit comprises a continuous heat exchanger 101 arranged between the still 102 and a cold plate 103. The continuous heat exchanger 101 comprises a coaxial unit arranged in a spiral, through which the two paths proceed in opposite directions, with the inner path surrounded by the outer path. Continuous heat exchangers can generally be used to obtain temperatures down to around 30 millikelvin. Step heat exchangers may be used to obtain yet lower temperatures by using large-surface-area sinters to overcome the Kapitza resistance between metals and liquid helium at low temperatures, although these generally require more helium-3 for operation than continuous heat exchangers. Two step heat exchangers 104 are arranged in a stack between the cold plate 103 and the mixing chamber 105. Each step heat exchanger forms a substantially disc-like structure, in which the two paths are separated by a foil. The number of step heat exchangers provided may be adjusted to suit the application.

Typically, in low temperature applications such as quantum information processing (QIP), various dissipative elements are installed to ensure adequate thermalisation of experimental wiring. Dissipated heat from resistive elements and conductive wiring adds to the load on the dilution refrigerator, which means that more cooling power is required in order to maintain a given base temperature for the system. A side effect of additional dissipation at the still is an increase in the helium-3 circulation rate of the dilution refrigerator. The circulation rate will have an optimum value at a given mixing chamber temperature, at which the cooling power available at the mixing chamber is maximised (or the operating temperature is minimised). Additional dissipation at the still may mean, therefore, that the optimum flow rate for the dilution refrigeration process cannot be attained.

As the scale of an application increases, the amount of dissipated heat will necessarily increase due to additionally installed elements. More powerful dilution units, or even multiple dilution unit circuits, can be installed to increase the available cooling power. However to improve the cooling power at the third stage is non-trivial and requires larger or more step heat exchanges to be provided. The step heat exchangers account for typically 50-70% of the helium-3 requirement of a dilution refrigerator, which is both rare and expensive. Reducing the helium-3 requirements of the system is therefore desirable. Installing more dilution units of the same design suffers from a similar problem in that it is an inefficient way of addressing a heat load applied at the second stage (where there is no active cooling process). It has previously been proposed to install a helium-4 refrigerator operating at around 1 kelvin onto a dilution refrigerator. This method increases the cooling power at the first stage however it does not directly address the heat dissipated at lower temperature stages of the dilution refrigerator.

As such, it is desirable to provide a cryogenic cooling system designed to directly compensate for any heat loads applied at low temperatures.

SUMMARY OF THE INVENTION

In accordance with an aspect of the present invention, a cryogenic cooling system is provided comprising: a first stage, a second stage, and a third stage, wherein the second stage is arranged between the first stage and the third stage; a first dilution unit comprising a first still and a first mixing chamber, wherein the first still is thermally coupled to the first stage and the first mixing chamber is thermally coupled to the third stage; and a second dilution unit comprising a second still and a second mixing chamber, wherein the second still is thermally coupled to the first stage and the second mixing chamber is thermally coupled to the second stage.

Contrary to the prior art systems earlier discussed, a second dilution unit is provided which is arranged to apply cooling directly to the second stage. The second stage is therefore not reliant on the cooling power of the neighbouring stages in order to compensate for any heat loads applied to the second stage. Rather the second stage contains a respective active source of cooling in the form of the second mixing chamber. Previously, the absence of any such cooling source at the second stage limited the ability for each stage to obtain low temperatures, particular when heat loads are applied to the system. Increasing the cooling power at the second stage may have a number of further direct and indirect effects, such as decreased cooling requirements at the third stage, a greater capacity to tolerate heat loads without substantially raising the operational temperature of the system, and lower achievable base temperatures at one or more of the stages.

The second stage typically provides an intermediary thermal sink between the first and third stages. This reduces the heat load applied to the third stage, for example from the surrounding environment and any warmer components of the system. This enables the third stage to obtain a lower temperature than would otherwise be achievable. The first mixing chamber is therefore preferably configured to obtain a temperature below that of the second mixing chamber during operation of the first dilution unit and the second dilution unit. This lower temperature may result in part from the fact that the first mixing chamber is thermally coupled to the third stage rather than the second stage, reducing the conducted heat load, however it may also arise due to the first dilution unit having a different design to the second dilution unit. For example, the first mixing chamber may have a larger volume than the second mixing chamber and/or have a different configuration of heat exchangers. The actual temperature obtained by each stage and each component of the first and second dilution units will depend on the specifics of the application and, in particular, the heat loads applied to the stages during use.

Each dilution unit typically comprises a respective heat exchanging unit for providing a flow of an operational fluid (generally a mixture of helium-3 and helium-4) between the respective still and mixing chamber. At least a portion of the heat exchanging unit of the second dilution unit may comprise a continuous heat exchanger. Step heat exchangers can be used to obtain lower temperatures. However, it is envisaged that in most applications a step heat exchanger will not be required between the first stage and the second stage. Therefore, in order to reduce the amount of helium-3 required during operation, the heat exchanging unit of the second dilution unit instead preferably comprises a continuous heat exchanger positioned between the first stage and the second stage. In contrast it is generally envisaged that the first dilution unit may comprise one or more step heat exchangers arranged between the second and third stages. The second dilution unit will therefore typically form a "simpler" arrangement in comparison with the first dilution unit and may operate at higher temperatures as a result. However, the system could be modified to obtain lower temperatures at the second stage and/or to provide additional cooled stages. For example, the system may further comprise a fourth stage arranged between the first and second stage, wherein the continuous heat exchanger is arranged between the first stage and the fourth stage, and wherein the heat exchanging unit of the second dilution unit further comprises a step heat exchanging portion arranged between the fourth stage and the second stage. The step heat exchanging portion may comprise one or more step heat exchangers. The fourth stage may be passively cooled by out-flowing helium-3.

The system is typically arranged such that the first, second and third stages form a tiered arrangement. The fourth stage (where provided) may further form part of this tiered arrangement. The stages may hence be spatially dispersed along an axis, typically extending through a major surface of each said stage. Each still and mixing chamber is thermally coupled to a respective stage, as earlier discussed. This thermal coupling is typically achieved by directly mounting said components to the respective stage. However, they may alternatively be connected by a high conductivity member, for example formed of copper. Most typically the first and second stills are mounted to the first stage, the first mixing chamber is mounted to the third stage, and the second mixing chamber is mounted to the second stage. Each said stage may therefore comprise a platform onto which other components of the system may be mounted.

The cryogenic cooling system is preferably arranged such that operation of the first dilution unit and second dilution unit causes each stage to obtain a respective base temperature, wherein the third stage is arranged to obtain a base temperature that is lower than the second stage, and the second stage is arranged to obtain a base temperature that is lower than the first stage. By "base temperature" we refer to the lowest temperature obtainable by a particular component during steady state operation of the system. The above arrangements allow the second stage to obtain lower temperatures than is possible in the prior art. For example, the base temperature of the second stage may be from 20 to 100 millikelvin, more preferably from 20 to 50 millikelvin. The base temperature of the first stage is typically between 0.5 and 2 kelvin; the base temperature of the third stage is typically less than 25 millikelvin, and preferably less than 10 millikelvin. Actual base temperatures for all stages will depend on the specifics of the application.

The system typically further comprises a heat radiation shield arranged to surround the first, second and third stages. A fourth stage, if provided, may also be surrounded by the heat radiation shield. A mechanical refrigerator may be thermally coupled to the heat radiation shield such that upon operation of the mechanical refrigerator, the heat radiation shield and contained stages would be cooled. The mechanical refrigerator may be a Stirling refrigerator, a Gifford-McMahon (GM) refrigerator, or a pulse-tube refrigerator (PTR). The cooling may also be achieved using a reservoir of a liquid cryogen. The system may further comprise additional heat radiation shields, all of which can be contained within an outer vacuum vessel.

The dilution units are generally cooled by flowing an operational fluid through a cooling circuit. The system may comprise a cooling circuit configured to circulate operational fluid around the first dilution unit and the second dilution unit. The cooling circuit may comprise a condensing line, wherein a first portion of the condensing line extends from a first position inside the heat radiation shield to the first dilution unit, and a second portion of the condensing line extends from said first position to the second dilution unit. The cooling circuit may additionally comprise a still pumping line, wherein a first portion of the still pumping line extends from the first dilution unit to a second position inside the heat radiation shield, and a second portion of the still pumping line extends from the second dilution unit to said second position inside the heat radiation shield. An advantage of this configuration, with a single condensing line and a single still pumping line connecting a reservoir of operational fluid to conduits within an outer vacuum vessel containing the system, is the reduced number of conduits extending through the system, each of which may form a potential thermal leak. Such an arrangement correspondingly may reduce the amount of unwanted thermal exchange between different components of the system. The cooling of the first dilution unit and the second dilution unit may be controlled separately through the use of one or more valves and one or more impedance control devices provided along the cooling circuit. In an alternative arrangement, for example in which a heat radiation shield is not thermally coupled to the mechanical refrigerator, one or both of the first and second positions may simply be arranged between a lowest temperature cooling stage of the mechanical refrigerator and one of the first, second and third stages (most typically the first stage).

The system may alternatively comprise a first cooling circuit configured to circulate a first operational fluid around the first dilution unit and a second cooling circuit configured to circulate a second operational fluid around the second dilution unit. The second cooling circuit may operate independently of the first cooling circuit. It should be understood that the first and second operational fluids will typically be formed of the same mixture of helium-3 and helium-4 isotopes however they may be fluidly disconnected by the respective cooling circuits. The flow of operational fluid around each cooling circuit, and potentially even the ratio of helium-3 to helium-4 in the mixture, could therefore be selected so as to enhance the operational efficiency of the system. An advantage of separate cooling circuits is the ability to operate the dilution units separately and with different operational fluids.

A particular advantage is provided when the system further comprises electrical elements that are mounted to one or more of the stages, wherein operation of the electrical elements dissipates heat onto the stages. Such electrical elements may be required for certain applications and experiments performed using the system. The elements may be mounted directly on the stages, as well as between them. Typically, the electrical elements are arranged so as to reduce the heat load on the third stage. For example, one or more of the electrical elements may be mounted to the second stage. Although operation of the electrical elements may provide an undesirable heat load, this is compensated for by the increased cooling power provided to the second stage. The active cooling of the second stage achieved through operation of the second dilution unit enhances the cooling power of the system, and reduces the dependency of the third stage base temperature on the dissipation at the second stage.

The electrical elements described above may be used in any number of applications, however a particular benefit is provided wherein the electrical elements form part of a quantum information processing (QIP) system. QIP is a key area of advancing research, and the electrical elements used in QIP systems typically provide substantial heat loads on a cryogenic system. Typical heat loads applied by the electrical elements may be around 200 microwatts, and would generally cause the temperature of the third stage to rise (typically at a rate of around 1 millikelvin per microwatt). For example in the prior art such heat loads may result in a temperature increase at the second stage of around 200 millikelvin, however operation of the above system may advantageously result in a much smaller temperature increase. It is expected that the heat dissipation of QIP systems will increase as the systems scale up and more electrical elements, or electrical elements that dissipate more heat, are therefore included.

The second mixing chamber is typically operable to provide cooling power of at least 100 microwatts, preferably at least 200 microwatts, to the second stage when the second mixing chamber (or equivalently the second stage) is at a temperature below 200 millikelvin and preferably below 100 millikelvin. Such a cooling power can generally be used to cool the second stage to maintain a temperature of about 100 millikelvin at the second stage despite any heat loads applied by electrical elements of the system (such as those described above). Preferably the cooling power of the second mixing chamber at its intended operating temperature (typically below 860 millikelvin) is equal or higher than the heat load applied to the second stage by any electrical elements that are provided. The first and second still may be operated so as to apply a cooling power of at least 10 milliwatts to the first stage when the first stage is at 1 kelvin, whereas the first mixing chamber may be operated so as to apply a cooling power of 1-10 microwatts to the third stage when the first mixing chamber is at 10 millikelvin.

Up until now the advantages of the system have been considered with just first and second dilution units as described. However, the system could further comprise one or each of: a further dilution unit thermally coupled to the first stage and the third stage, and a further dilution unit thermally coupled to the first stage and the second stage. These can be used to enhance the cooling power of the system depending on the requirements of the application.

Optionally, the system further comprises a sample holder mounted to the third stage. The lowest base temperature achieved in the system will typically be at the third stage, and so mounting a sample to the third stage using the sample holder is desirable in many applications.

BRIEF DESCRIPTION OF THE DRAWINGS

Embodiments of the invention will now be described with reference to the accompanying drawings in which.

DETAILED DESCRIPTION

Figure 1:
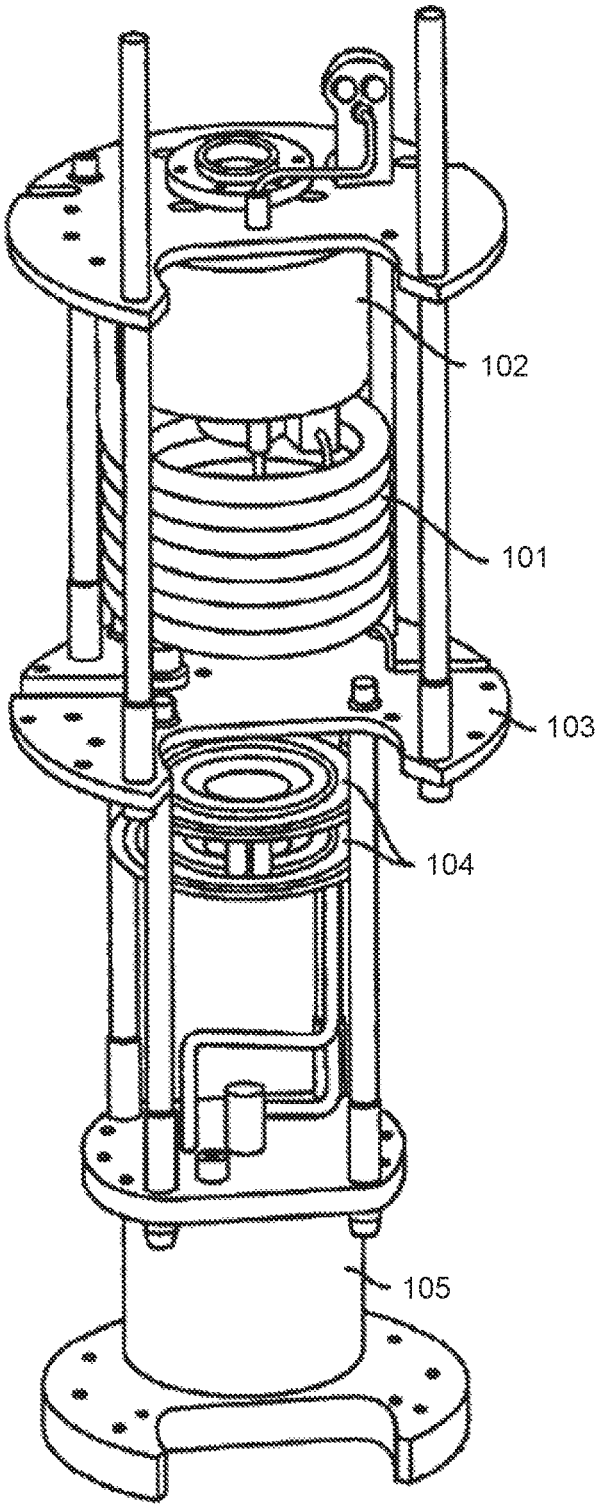
FIG 1 PRIOR ART
FIG. 1 is a prior art example of a dilution unit for use in a dilution refrigerator.
Figure 2:
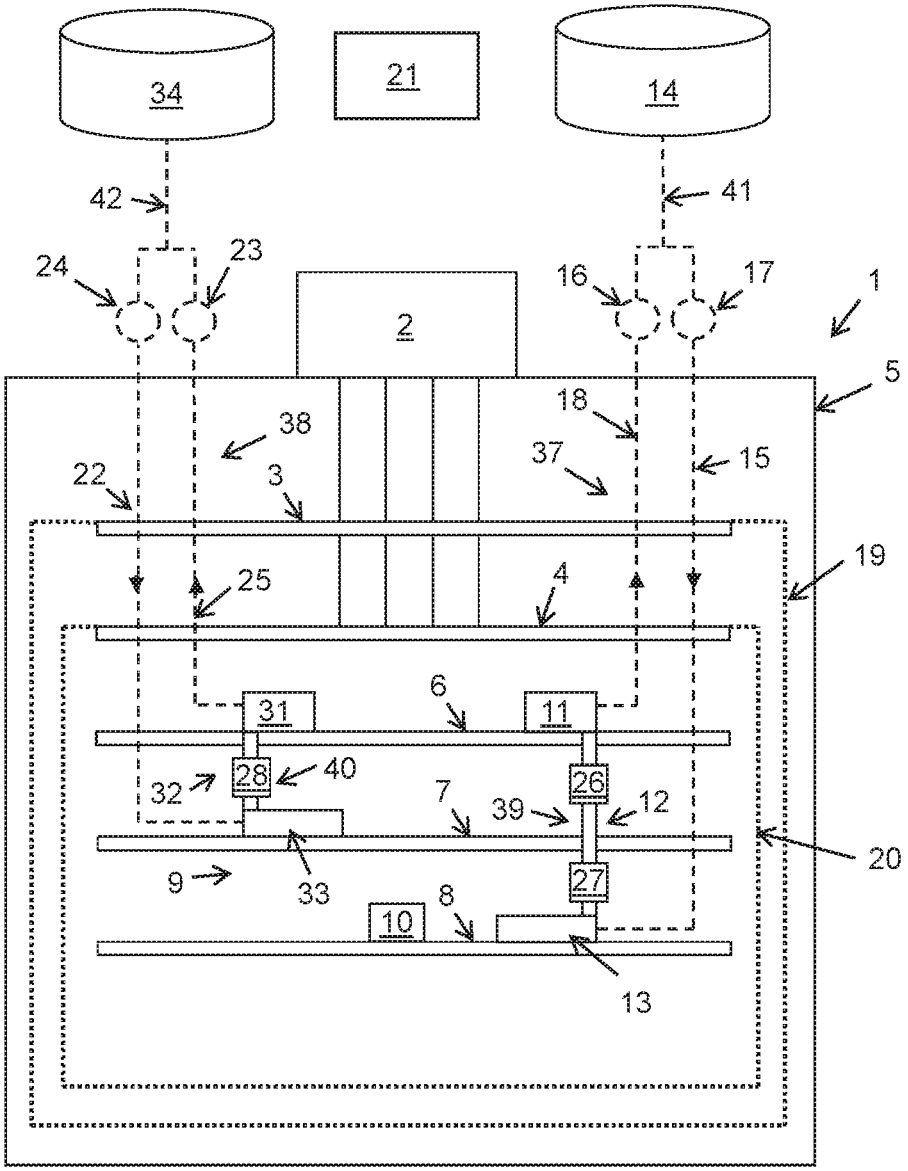
FIG. 2 is a schematic illustration of a cryogenic cooling system in accordance with a first embodiment of the invention.

FIG. 2 provides a sectional view of the interior of a cryogenic cooling system, the main part of which is a cryostat 1. Cryostats are well known in the art and are used to provide low temperature environments for various apparatus. The cryostat 1 is typically evacuated when in use, this being to improve the thermal performance by the removal of convective and conductive heat paths through any gas within the cryostat.

The cryostat 1 comprises a large hollow cylinder, typically formed from stainless steel or aluminium, which comprises an outer vacuum vessel 5. A tiered arrangement 9, comprising a plurality of spatially dispersed stages, is provided within the cryostat 1. Various apparatus for performing low temperature procedures, such as experiments, are mounted to the tiered arrangement 9. The tiered arrangement 9 comprises a first stage 6, a second stage 7 and a third stage 8. Each stage provides a platform formed from high conductivity material (e.g. copper) and is spaced apart from the remaining stages by low thermal conductivity rods (not shown). The second stage 7 is commonly referred to as the "cold plate" and provides an intermediary heat sink between the first stage 6 and the third stage 8. A sample holder 10 is shown mounted to the third stage 8, which forms the lowest temperature stage during steady state operation of the system. Ports (not shown) may be provided in the cryostat 1 to enable an experimental "probe" to pass into the interior of the cryostat 1 for providing sample delivery whilst maintaining a vacuum inside the cryostat 1.

The cryostat 1 in the present example is substantially cryogen free (also referred to in the art as "dry") in that it is not principally cooled by contact with a reservoir of cryogenic fluid. The cooling of the cryostat is instead achieved by use of a mechanical refrigerator, which may be a Stirling refrigerator, a Gifford-McMahon (GM) refrigerator, or a pulse-tube refrigerator (PTR). However, despite being substantially cryogen free, some cryogenic fluid is typically present within the cryostat when in use, including in the liquid phase, as will become clear. The main cooling power of cryostat 1 is provided in this embodiment by a PTR 2. PTRs generate cooling by controlling the compression and expansion of a working fluid which is supplied at high pressure from an external compressor. The first PTR stage 3 will typically have a relatively high cooling power in comparison with the second PTR stage 4. In the present case, the PTR 2 cools a first PTR stage 3 to about 50 to 70 kelvin and a second PTR stage 4 to about 3 to 5 kelvin. The second PTR stage 4 therefore forms the lowest temperature stage of the PTR 2.

Various heat radiation shields are provided inside the outer vacuum vessel 5, wherein each shield encloses each of the remaining lower base-temperature components. The first PTR stage 3 is thermally coupled to a first radiation shield 19 and the second PTR stage 4 is thermally coupled to a second radiation shield 20. The first radiation shield 19 surrounds the second radiation shield 20 and the second radiation shield 20 surrounds each of the first, second and third stages 6-8. Additionally, each stage 6, 7, 8 may be connected to a respective heat radiation shield (not shown for the sake of clarity), in order to reduce any unwanted thermal communication between the stages.

Two dilution refrigerators are provided. The first dilution refrigerator comprises a first dilution unit 12 fluidly coupled to a first storage vessel 14 by a first cooling circuit 37. The second dilution refrigerator comprises a second dilution unit 32 fluidly coupled to a second storage vessel 34 by a second cooling circuit 38. The first and second storage vessels 14, 34 are arranged outside the cryostat 1 and each contain an operational fluid in the form of a mixture of helium-3 and helium-4 isotopes. The mixture of these isotopes may be different in the first and second storage vessels 14, 34 (e.g. adjusted for the operational parameters of the first and second dilution units 12, 32 respectively so as to lower the overall requirement for helium-3) or the same. In an alternative embodiment the first and second cooling circuits 37, 38 may draw operational fluid from a common external storage vessel. This may provide enhanced usability and simplify storage of the operational fluid. Various pumps 16, 17, 23, 24 are also arranged outside the cryostat 1, along conduits of the first and second cooling circuits 37, 38 for controlling a flow of the operational fluids around these circuits. Solid arrowheads are included to FIG. 2 to indicate the direction of this flow during normal operation of the system.

A first still 11 of the first dilution unit 12 and a second still 31 of the second dilution unit 32 are each mounted to the first stage 6 and are operable to cool the first stage 6 to a base temperature of 0.5-2 kelvin, at which they have a combined cooling power in excess of 20 milliwatts. A first mixing chamber 13 of the first dilution unit 12 is mounted to the third stage 8 and is operable to cool the third stage 8 to a base temperature below 10 millikelvin, at which it has a cooling power of about 5 microwatts. A second mixing chamber 33 of the second dilution unit 32 is mounted to the second stage 7 and is operable to cool the second stage 7 to a base temperature of 20-100 millikelvin (at 100 millikelvin it has a cooling power of around 200 microwatts). Importantly, the second mixing chamber 33 forms an active source of cooling at the second stage 7, and therefore the second stage 7 is not reliant on the cooling power at the first stage 6 or the third stage 8 in order to maintain a low temperature. Furthermore, the provision of the second dilution unit 32 causes the second stage 7 to obtain a particularly low temperature using a relatively low quantity of cryogenic fluid.

The first cooling circuit 37 comprises a first supply line 41 which provides a conduit to facilitate a flow of a first operational fluid from the first storage vessel 14 to a first condensing line 15. This fluid may then be conveyed along the first condensing line 15 to the first mixing chamber 13. The first condensing line 15 is thermally coupled to each stage of the tiered arrangement 9 and further comprises one or more impedances (not shown) for reducing the temperature of the first operational fluid due to the Joule-Thomson effect as it flows towards the first mixing chamber 13. A first compressor pump 17 is arranged along the first condensing line 15 for providing this flow at a pressure of 0.5-2 bar. It should be appreciated that FIG. 2 is a schematic illustration only. Although not shown, in practice a portion of the first condensing line 15 will extend through from an upper portion of the first dilution unit 12 into the first mixing chamber 13. A first still pumping line 18 is arranged to convey the first operational fluid from the first mixing chamber 13, through the first still 11 to a position exterior to the cryostat 1. The first operational fluid may then be circulated from this position back into the first condensing line 15. A first turbomolecular pump 16 is arranged along the first still pumping line 18 for providing a high vacuum on the low pressure side of the circuit (for example less than 0.1 mbar), and so enables the flow of the first operational fluid away from the first still 11.

The second cooling circuit 38 operates in a similar manner to the first cooling circuit 37, albeit for providing a flow of a second operational fluid around the second dilution unit 32. A second supply line 42 extends from the second storage vessel 34 to a second condensing line 22. Similar to the first condensing line 15, the second condensing line 22 conveys the second operational fluid to the second mixing chamber 33. The second condensing line 22 is thermally coupled to each stage of the tiered arrangement 9 and further comprises one or more impedances (not shown) for reducing the temperature of the second operational fluid prior to arriving at the second mixing chamber 33. A second still pumping line 25 provides a flow of the second operational fluid from the second mixing chamber 33, through the second still 31 back to a position exterior to the cryostat 1, whereupon it may be circulated back along the second condensing line 22. A second turbomolecular pump 23 and a second compressor pump 24 are provided along the second still pumping line 25 and the second condensing line 22 respectively for controlling the flow of the second operational fluid, as before.

The first dilution unit 12 comprises a heat exchanging unit 39 in which the first operational fluid flows along a first path from the first mixing chamber 13 to the first still 11. A portion of the first condensing line 15 forms a second path extending from an upper portion of the first dilution unit 12, along the heat exchanging unit 39 and into the first mixing chamber 13. The heat exchanging unit 39 of the first dilution unit 12 comprises a continuous heat exchanger 26 positioned between the first stage 6 and the second stage 7, and a step heat exchanging portion 27 positioned between the second stage 7 and the third stage 8. In the continuous heat exchanger 26 of the first dilution unit 12, the two paths proceed in opposite directions in a coaxial unit arranged in a spiral. In the step heat exchanging portion 27 of the first dilution unit 12, multiple spatially dispersed step heat exchangers are arranged in a stack. Each step heat exchanger forms a substantially disc-like structure, in which the two paths are separated by a foil. The out-flowing helium-3 flowing from the first mixing chamber 13 to the first still 11 along the heat exchanging unit 39 of the first dilution unit 12 forms a passive source of cooling on the second stage 7 in addition to the active cooling by the second mixing chamber 33.

A heat exchanging unit 40 is provided for the second dilution unit 32, in which operational fluid flows from the second still 31 to the second mixing chamber 33, and the second mixing chamber 33 to the second still 31, through adjacent coolant paths in a similar manner to the heat exchanging unit 39 of the first dilution unit 12. However, the heat exchanging unit 40 of the second dilution unit 32 does not contain a step heat exchanging portion. Instead it comprises only a continuous heat exchanger 28 positioned between the first stage 6 and the second stage 7, in which the two coolant paths again proceed in opposite directions in a coaxial unit arranged in a spiral. The continuous heat exchanger 28 as described requires a low quantity of helium-3 for operation in comparison with step heat exchangers. The second dilution unit 32 can thus be operated to apply effective cooling directly to the second stage 7 at a reduced cost to the user in comparison with the cost of operating a second dilution unit comprising both continuous and step heat exchangers.

Electrical elements can be mounted to one or more of the first stage 6, second stage 7 and third stage 8. The electrical elements may include electrical devices (such as attenuators, filters, circulators or other microwave components, amplifiers, resistors, transistors, thermometers, capacitors, inductors) as well as electrical conductors (such as wiring, which may be high-frequency wiring), depending on the application. Such electrical elements may form part of a quantum information processing system, a terahertz detector system, or a low temperature optical system for example (it will be appreciated that the large heat loads, which the described system is designed to mitigate, are radiative rather than conductive in the case of optical systems). Most typically the wiring will pass through each stage of the tiered arrangement 9 for coupling an input signal from the control system 21 to the sample located at the sample holder 10. A plurality of electrical devices will be provided along this wiring, typically including filters, such as low-pass and band-pass filters for conditioning the input signal. Amplifiers, such as high electron mobility transistor (HEMT) amplifiers or travelling-wave parametric amplifiers, may additionally be installed along this wiring to amplify the output signal conducted from the sample to the control system 21. Operation of these electrical elements locally dissipates heat onto any of the above stages 3, 4, 6, 7, 8 on which the electrical elements are mounted. However, the active cooling of the second stage 7 as described above increases the cooling power of the system, and reduces the dependency of the temperature of the third stage 8 on the dissipation at the second stage 7. Thus, heat dissipated locally at the second stage 7 will have less of an effect on the temperature of the third stage 8.

A control system 21 is provided to control each of the parts of the system including the operation of the dilution units, pumps and associated valves, the monitoring of sensors and the operation of other ancillary equipment to perform desired procedures on the sample. A suitable computer system is used to achieve this, although manual control is also envisaged.

Operation of the system during a cool down process in which the system is cooled from room temperature to its operational base temperature will now be discussed. Starting from an evacuated state in which all of the components of the cryostat 1 are in thermal equilibrium, the PTR 2 is operated so as to apply cooling to the interior of the cryostat 1. The temperature of the first PTR stage 3 and the second PTR stage 4 will reduce in the usual manner. When the second PTR stage 4 reaches a temperature of around 10 kelvin, the control system 21 will initialise circulation of the first operational fluid around the first cooling circuit 37. The first operational fluid will then flow from the first supply line 41 to the first condensing line 15. Continuous circulation of the first operational fluid around the first dilution refrigerator will cause the temperature of the first operational fluid to gradually decrease as the temperature of the PTR 2 reduces further.

The first operational fluid will eventually condense as it flows along the first condensing line 15, prior to arrival at the first mixing chamber 13. At temperatures below about 860 millikelvin, the operational fluid separates into a concentrated phase and a dilute phase. The concentrated phase is rich in helium-3, and the dilute phase has a small fraction of helium-3 diluted in helium-4. During operation, the phase boundary is contained within the first mixing chamber 13. Operational fluid is transferred from the first mixing chamber 13 to the first still 11 along the heat exchanging unit 39 of the first dilution unit 12. A heater is operated at the first still 11 to evaporate helium-3 from the first still 11, which is then pumped along the still pumping line 18 using the turbomolecular pump 16. The first operational fluid is then circulated back along the first condensing line 15 using the first compressor pump 17.

The control system 21 will typically initialise circulation of the operational fluids from both cooling circuits and the respective dilution units at the same time. A similar process is therefore applied concurrently in respect of the second dilution refrigerator. The circulation of the operational fluids will cause the temperature of the tiered arrangement 9 to gradually reduce until each stage obtains its respective base temperature. The electrical elements provided to the system may then be operated as required depending on the application. Advantageously, any dissipative heat loads applied by these elements at the second stage 7 will be compensated for by the additional cooling power provided at this stage by the second mixing chamber 33.

Figure 3:
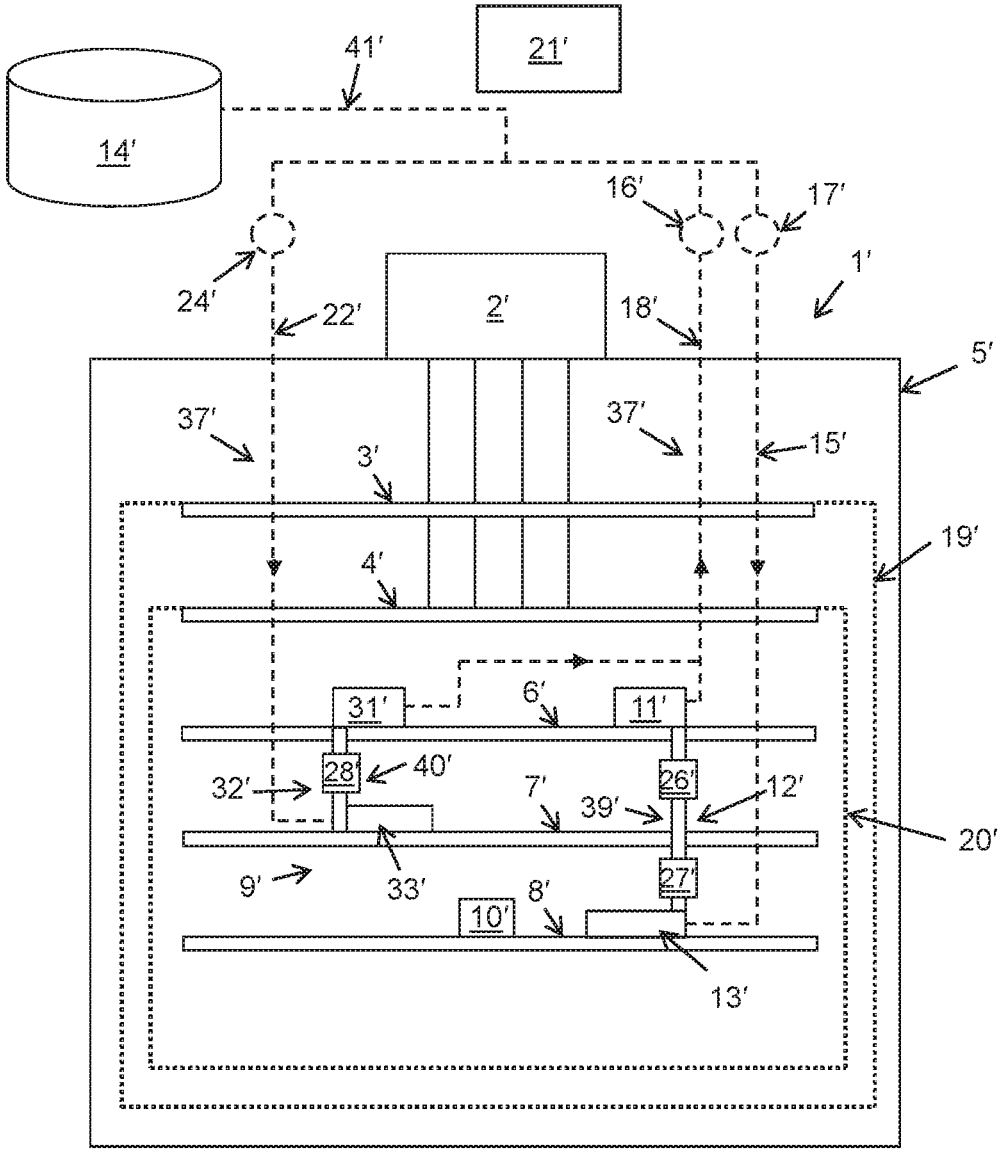
FIG. 3 is a schematic illustration of a cryogenic cooling system in accordance with a second embodiment of the invention.

Additional embodiments of the invention will now be described. Primed, double primed and triple primed reference numerals are used to designate similar apparatus features between each embodiment. FIG. 3 provides a sectional view of the interior of a cryogenic cooling system according to a second embodiment of the invention. The structure and operation of the cryostat 1' is as detailed in the description of FIG. 2. The second embodiment differs from the first embodiment in that a common cooling circuit 37' is provided for the first dilution unit 12' and second dilution unit 32'.

A second condensing line 22' extends from the supply line 41' to the second mixing chamber 33' for providing a flow of operational fluid from the storage vessel 14' to the second dilution unit 32'. A compressor pump 24' is provided along the second condensing line 22' for controlling this flow. The still pumping line 18' extends to a position within the second radiation shield 20' where a junction is formed in the still pumping line 18'. A first portion of the still pumping line 18' extends from the first dilution unit 12' to the junction, and a second portion of the still pumping line 18' extends from the second dilution unit 32' to the junction. A low-pressure pump 16' is used to circulate operational fluid. Each of the pumps 16', 17', 24' is operated by the control system 21' to ensure operation of the first and second dilution units 12', 32'. It is appreciated that this operation may require further valves at room temperature under the control of control system 21', not shown in the figure for the sake of clarity. The provision of a single cooling circuit 37' for operating both dilution units 12', 32' may be particularly desirable in some applications because it reduces the number of conduits within the cryostat 1'. This simplifies the arrangement, which in turn simplifies the manufacture process and allows additional space for other components to be contained within the cryostat 1'. Furthermore since each conduit that extends between the different stages can form a potential heat leak, it reduces the amount of unwanted thermal exchange between different components of the system.

Figure 4:
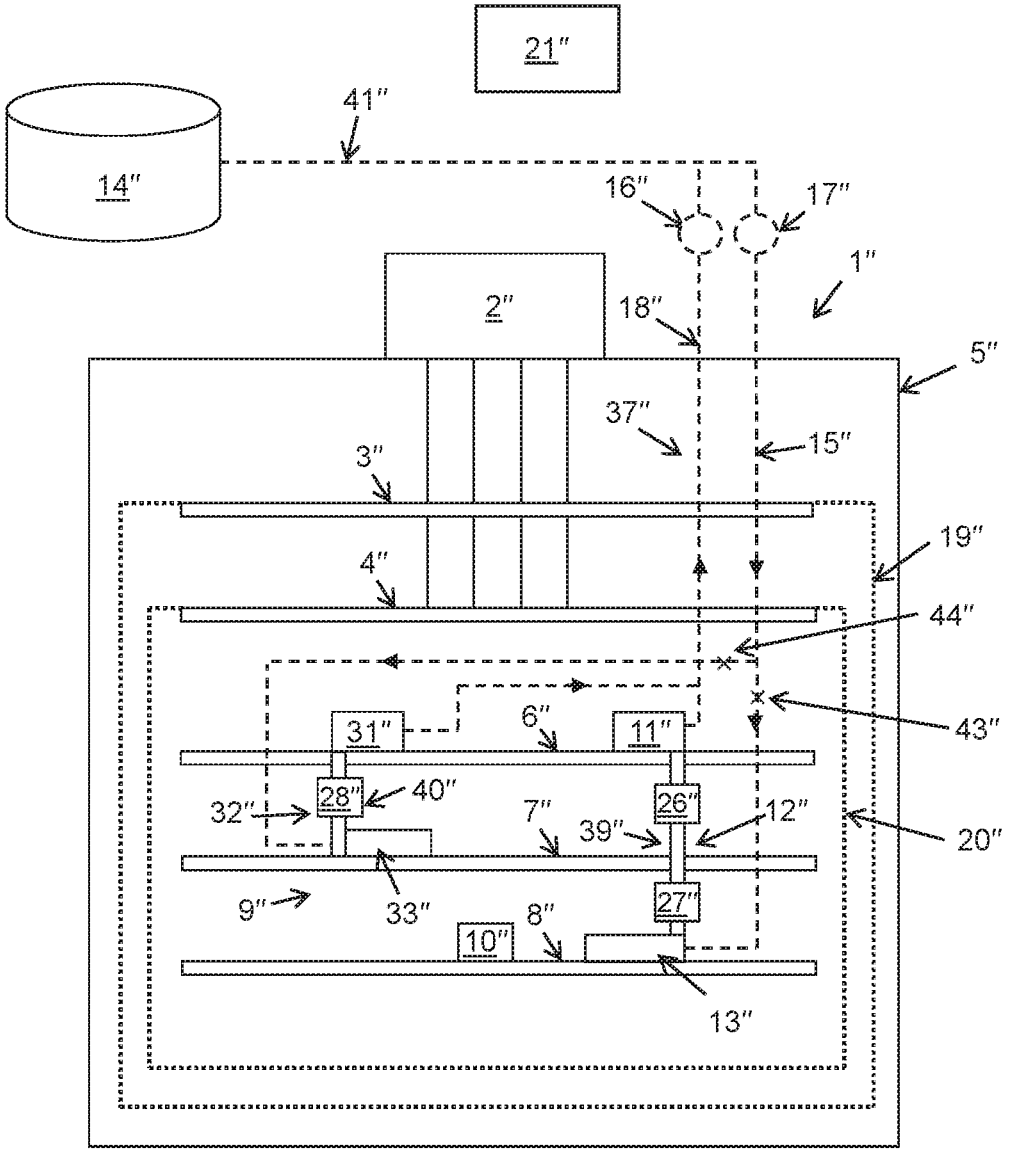
FIG. 4 is a schematic illustration of a cryogenic cooling system in accordance with a third embodiment of the invention.

FIG. 4 provides a sectional view of the interior of a cryogenic cooling system according to a third embodiment of the invention, in which the structure and operation of the cryostat 1" is as detailed in the description of the second embodiment (FIG. 3). The third embodiment differs from the second embodiment in that the condensing line 15" divides within the cryostat 1", resulting in a further reduction of the number of conduits within the cryostat 1". Each conduit may form a potential heat leak, and thus reducing the number of conduits extending along a temperature gradient within the system has the advantage that the number of potential heat leaks, and the amount of unwanted thermal exchange between different components of the system, are reduced.

The condensing line 15" delivers operational fluid to the first dilution unit 12", and also to the second dilution unit 32". In FIG. 4, the condensing line 15" is shown to extend to a first position within the second radiation shield 20" where a first junction is formed in the condensing line 15". A first portion of the condensing line 15" extends from the first junction to the first dilution unit 12" and a second portion of the condensing line 15" extends from the first junction to the second dilution unit 32". A first impedance control device 43" is provided along the first portion of the condensing line 15", and a second impedance control device 44" is provided along the second portion of the condensing line 15". The impedance control devices 43" and 44" are used to control the impedance. A fixed impedance may be provided for example by reducing the diameter of a section of the condensing line, wherein said section would form part of an impedance control device. An adjustable impedance may also be provided through use of, for example, a needle valve, wherein said valve would form part of an impedance control device.

The still pumping line 18" is shown in FIG. 4 to extend to a second position within the second radiation shield 20" where a second junction is formed in the still pumping line 18". A first portion of the still pumping line 18" extends from the first dilution unit 12" to the second junction, and a section portion of the still pumping line 18" extends from the second dilution unit 32" to the second junction.

In FIG. 4, the first junction in the condensing line 15" and the second junction in the still pumping line 18" are shown to occur within the second radiation shield 20", between the second PTR stage 4" and the first stage 6". In further embodiments (not shown) one or both of the junctions may be outside the cryostat 1", within the cryostat 1" and outside the first radiation shield 19", or between the first radiation shield 19" and the second radiation shield 20".

Figure 5:
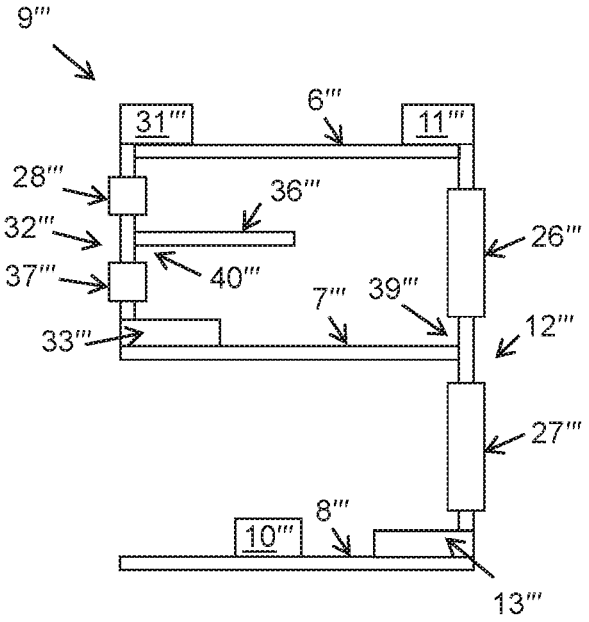
FIG. 5 is a schematic illustration of a cryogenic cooling system in accordance with a fourth embodiment of the invention.

FIG. 5 illustrates a sectional view of a tiered arrangement 9''' of a cryogenic cooling system according to a fourth embodiment. The tiered arrangement 9''' comprises first and second dilution units 12''', 32''' attached thereto. The surrounding cryostat (including any cooling circuits provided) is not shown for sake of clarity, although it may take the form earlier discussed with reference to FIGS. 2 to 4. The tiered arrangement 9''' further comprises a fourth stage 36''' providing an additional heat sink positioned between the first stage 6''' and the second stage 7'''. The fourth stage 36''' is formed from high conductivity material (e.g. copper) and is spaced apart from the other stages by low thermal conductivity rods. Microwave components or other electrical elements such as those described above, can be mounted to the fourth stage 36'''.

The second dilution unit 32' comprises a heat exchanging unit 40' in which operational fluid flows from the second still 31''' to the second mixing chamber 33' and the second mixing chamber 33' to the second still 31' through adjacent paths in a counter-flow arrangement. The heat exchanging unit 40''' of the second dilution unit 32' in this embodiment comprises a continuous heat exchanger 28' positioned between the first stage 6''' and the fourth stage 36', and a step heat exchanging portion 37' positioned between the fourth stage 36''' and the second stage 7'''. This arrangement can be used to obtain lower temperatures at the second stage 7''' than was typically achievable in the earlier embodiments (albeit using a higher quantity of helium-3). Additionally, the provision of an additional cooled stage 36''' advantageously provides a further body onto which further electrical elements may be mounted, away from the third stage 8', thereby reducing the heat load conducted to the third stage 8'''.

In another embodiment (not shown), an additional dilution unit may be provided, for example for applying cooling directly to the first stage and the second or third stage. In yet further embodiments, the cooldown process may be assisted by the use of one or more heat pipes and/or heat switches. For example, a heat pipe containing a condensable coolant may be arranged between the first and second PTR stages and a gas gap heat switch may be arranged between the second PTR stage the first stage of the tiered arrangement. An additional gas gap heat switch may then be provided between each adjacent stage of the tiered arrangement so as to provide selectively coupleable thermal links between these stages. The heat pipe and heat switches may be operated in a "closed" state during the cooldown process, so that the lower sections of the refrigerator can be pre-cooled from ambient temperatures, e.g. by the pulse tube cooler, and then "opened" so as to thermally disconnect these stages prior to initialising the flow of the operational fluid around the dilution units. Such thermal disconnection may be achieved by removing any thermally conductive gas contained within the gas gap heat switches and by solidification of the coolant contained within the heat pipe.

In conclusion it will be appreciated that an improved cryogenic cooling system is therefore provided in which an active source of cooling is provided on the second stage by a second dilution unit. Additional heat may therefore be dissipated onto the second stage, for example by electrical elements mounted thereto, without raising the base temperature of the third stage to the extent that would be inevitable without the addition of the second dilution unit. Lower temperatures at each stage may therefore be achieved.

The invention claimed is:

1. A cryogenic cooling system comprising:

a first stage, a second stage, and a third stage, wherein the second stage is arranged between the first stage and the third stage;

a first dilution unit comprising a first still and a first mixing chamber, wherein the first still is thermally coupled to the first stage and the first mixing chamber is thermally coupled to the third stage; and a second dilution unit comprising a second still and a second mixing chamber, wherein the second still is thermally coupled to the first stage and the second mixing chamber is thermally coupled to the second stage;

wherein the first still and the second still are mounted to the first stage, the first mixing chamber is mounted to the third stage, and the second mixing chamber is mounted to the second stage.

2. The system according to claim 1, wherein the first mixing chamber is configured to obtain a temperature below that of the second mixing chamber.

3. The system according to claim 1, wherein the second dilution unit further comprises a heat exchanging unit fluidly coupling the second still to the second mixing chamber, wherein at least a portion of the heat exchanging unit comprises a continuous heat exchanger.

4. The system according to claim 3 further comprising a fourth stage arranged between the first stage and the second stage, wherein the continuous heat exchanger is arranged between the first stage and the fourth stage, and wherein the heat exchanging unit of the second dilution unit further comprises one or more step heat exchangers arranged between the fourth stage and the second stage.

5. The system according to claim 1, wherein the system is arranged such that operation of the first dilution unit and the second dilution unit causes each said stage to obtain a respective base temperature, wherein the third stage is arranged to obtain a base temperature that is lower than that of the second stage, and the second stage is arranged to obtain a base temperature that is lower than that of the first stage.

6. The system according to claim 5, wherein the base temperature of the second stage is from 20 to 100 millikelvin.

7. The system according to claim 5, wherein the base temperature of the second stage is from 20 to 50 millikelvin.

8. The system according to claim 5, wherein the base temperature of the first stage is from 0.5 to 2 kelvin.

9. The system according to claim 5, wherein the base temperature of the third stage is less than 25 millikelvin.

10. The system according to claim 5, wherein the base temperature of the third stage is less than 10 millikelvin.

11. The system according to claim 1, further comprising a heat radiation shield arranged to surround the first, second and third stages, and a mechanical refrigerator thermally coupled to the heat radiation shield.

12. The system according to claim 11, further comprising a cooling circuit configured to circulate operational fluid around the first dilution unit and second dilution unit.

13. The system according to claim 12, wherein the cooling circuit comprises a condensing line, wherein a first portion of the condensing line extends from a first position inside the heat radiation shield to the first dilution unit, and a second portion of the condensing line extends from said first position to the second dilution unit.

14. The system according to claim 13, wherein the cooling circuit further comprises a still pumping line, wherein a first portion of the still pumping line extends from the first dilution unit to a second position inside the heat radiation shield, and a second portion of the still pumping line extends from the second dilution unit to said second position.

15. The system according to claim 1, further comprising a first cooling circuit configured to circulate a first operational fluid around the first dilution unit and a second cooling circuit configured to circulate a second operational fluid around the second dilution unit.

16. The system according to claim 1, further comprising electrical elements that are mounted to one or more stages, wherein operation of the electrical elements locally dissipates heat.

17. The system according to claim 16, wherein one or more of the electrical elements is mounted to the second stage.

18. The system according to claim 1, wherein the second mixing chamber is operable to apply a cooling power of at least 100 microwatts to the second stage when the second mixing chamber is at a temperature below 200 millikelvin.

19. The system according to claim 1, further comprising one or each of: a further dilution unit thermally coupled to the first stage and the third stage, and a further dilution unit thermally coupled to the first stage and the second stage.

* * * * *